United States Patent [19]

Rees

[11] Patent Number: 4,738,628

[45] Date of Patent: Apr. 19, 1988

[54] GROUNDED METAL COUPLING

[75] Inventor: David G. Rees, Goldsboro, N.C.

[73] Assignee: Cooper Industries, Houston, Tex.

[21] Appl. No.: 912,710

[22] Filed: Sep. 29, 1986

[51] Int. Cl.[4] ..... H01R 4/66

[52] U.S. Cl. ..... 439/95; 439/97; 439/332; 439/862

[58] Field of Search ..... 339/14, 263 R, 5, 6, 339/8, 143, 136, 252 R, 252 S, 253 R, 253 S, 254 R, 254 M, 88, 89, 90, 59, 61, 91 B

[56] References Cited

U.S. PATENT DOCUMENTS

| | | | |
|---|---|---|---|
| 2,410,618 | 11/1946 | Zelov | 339/14 R |
| 3,171,706 | 3/1965 | Daniels et al. | 339/14 R |
| 3,219,961 | 11/1965 | Bailey et al. | 339/14 R |
| 3,360,763 | 12/1967 | Rongy et al. | 339/14 R |
| 4,261,628 | 4/1981 | Gallagher et al. | 339/14 R |

FOREIGN PATENT DOCUMENTS

| | | | |
|---|---|---|---|
| 948610 | 2/1964 | United Kingdom | 339/14 R |

*Primary Examiner*—Gil Weidenfeld
*Assistant Examiner*—David Pirlot
*Attorney, Agent, or Firm*—E. E. Scott; R. L. Maxwell

[57] ABSTRACT

A grounding mechanism for an electrical connector having a metal generally U-shaped spring contact mounted on a cylindrical rubber or neoprene connector body which is connected directly to the internal ground contact within the connector body. Resilient tips on the body act to bias the free ends of the spring contact outwardly. The free ends of the spring contact stay in contact with a rotatable collar mounted over the body due to the compressed nature of the pre-formed metal spring contact, as well as the radially outward force of the resilient connector body tips acting on the free ends of the spring contact.

6 Claims, 1 Drawing Sheet

GROUNDED METAL COUPLING

BACKGROUND OF THE INVENTION

The invention relates generally to electrical connectors and more particularly to connectors of the plug and socket type having grounded rotating collars such as may be used for electrically and mechanically connecting lengths of cables to each other or to a stationary power supply or machine connector.

Electrical connectors of this type are frequently used in underground mining operations and other locations where it is both desirable and necessary to effect these connections rapidly. In mining operations it is typically required that electrical connectors conform with certain safety standards, such that there be no exposed ungrounded metal surfaces on the connector. Previously known connectors such as shown in U.S. Pat. No. 2,830,282 to Swan et al and, assigned to the same assignee as the present application, exist wherein rotating collars with pin and groove engagement provide for quick electrical and mechanical engagement of the electrical connector. Typically, these types of connectors are thoroughly insulated from electrically live or hot portions of the connector by a barrier of molded rubber or neoprene. The rotating metal collars are also covered with rubber or neoprene so that there are no exposed ungrounded metal components of the electrical connector.

However, in some situations the molded rubber can be cut or scraped off the ungrounded metal collars thereby creating a situation both hazardous and in violation of mining safety regulations. To adequately protect operating personnel, it is necessary to provide an electrical connector wherein the rotating collars are connected through a grounding mechanism to an external grounding source at all times when live power current is supplied to the connector.

SUMMARY OF THE INVENTION

It is therefore a primary object of this invention to provide an improved connector of the plug and socket type having rotatable connecting collars which are provided with a safe, constant current path to an external ground source to prevent electrocution in the event that the metal collar would accidentally become electrically energized.

It is another object of the invention to provide an improved connector having grounded rotatable collars which will allow for a rapid and easy electrical and mechanical connection.

It is still another object of the invention to provide an improved connector in which the mutually facing ends of the cooperating connector elements each have independently grounded rotating collars which can be connected to a ground line potential prior to connection of the live electrical load and where such grounding is maintained for a short period after the disconnection of the live electrical load.

In accordance with the present invention, an electrical connector of the plug and socket-type is provided having a pair of connector elements. Each connector element is connected to a length of cable or a stationary power supply or machine connector as required. The pair of connector elements may then be mechanically and electrically connected to provide a current path between the respective cables or cable and machine as the case may be. The connector elements each have a body and a rotating collar with pin and groove engagement between the respective collars to connect or disconnect the electrical connection. The rotating collars are provided with a sealed internal grounding mechanism providing a current path from the rotatable metal collar to the internal ground contact within each of the connector elements. Each of the collars is independently grounded within its respective connector element to provide a double backup system grounding both collars independently of each other to the connector elements' internal ground contact which is, in turn, connected to an external ground source.

The grounding mechanism includes a metal generally U-shaped spring contact mounted on the cylindrical rubber or neoprene connector body which is connected directly to the internal ground contact within the connector body. The body has resilient tips which act to bias the free ends of the spring contact outwardly such that the free ends extends out beyond the outer periphery of the body. The rotating metal collar is received about the connector body. The collar has an inside cylindrical surface of slightly larger diameter than the connector body. The free ends of the spring contact must be radially depressed in an inwardly direction before the collar will fit about the connector body. The spring contact stays in contact with the rotating collar at all times due to the compressed nature of the preformed metal spring contact, as well as the radially outward force of the resilient connector body tips acting on the free ends of the spring contact. A plurality of seal rings are positioned about the outer periphery of the connector body providing a seal between the connector body and the inside peripheral surface of the collar to prevent external contaminants from interfering with the electrical ground path between the collar and the internal ground contact within the body.

BRIEF DESCRIPTION OF THE DRAWINGS

The above and other objects and features of the invention will become apparent in the following detailed description of the preferred embodiment and claims taken in conjunction with the accompanying drawings which are a part of the specification and in which:

DETAILED DESCRIPTION OF A PREFERRED EMBODIMENT

Figure 1:
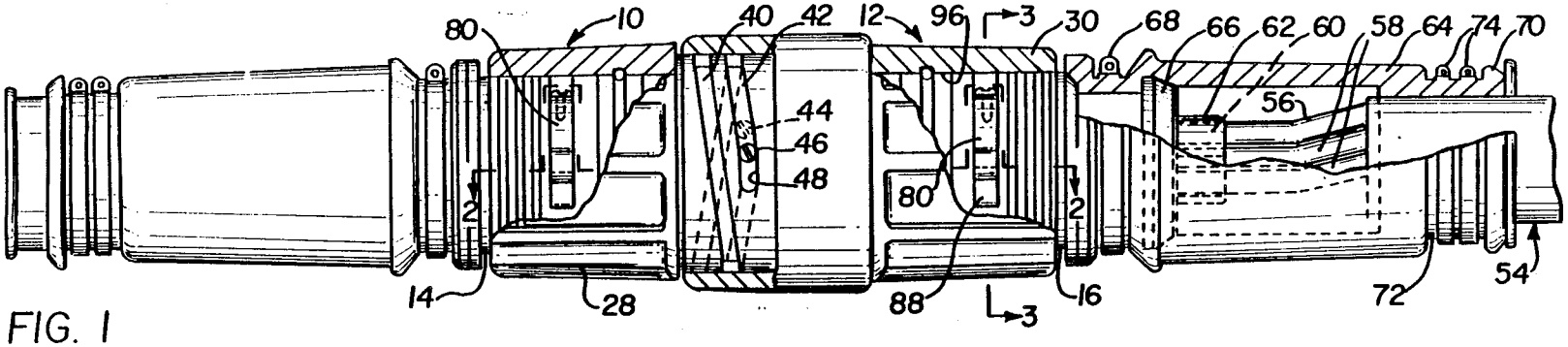
FIG. 1 is a longitudinal view with some parts in elevation and others broken away showing a pair of complimentary connectors designed and constructed according to the present invention shown in a coupled position.

Referring more specifically to the drawings, there is shown a pair of connector elements designated generally by the reference numerals 10 and 12 and including body portions 14 and 16, respectively. These bodies may be formed of any suitable insulating material such as rubber or neoprene and have secured therein a plurality of contact elements. These contact elements may either be in the form of plug type contacts or socket contacts, and each connector element 10 and 12 may contain both plug and socket contacts or exclusively one or the other. Typically, one connector element would contain all of the power plug contacts, along with the ground socket contact while the other connector element would contain all power socket contacts, along with the ground plug contact. In this manner, it would be impossible to incorrectly align the respective pairs of plug and socket contacts to accidently plug a power contact into the ground socket contact.

In FIG. 1, a connector element is shown having three power contacts and one ground contact. The plug contact 20 for the ground circuit being carried by body 16 or connector 12 while its cooperating socket contact 22 is carried by the body 14 of connector 10. The plug contacts 24 of the power circuit are secured within body 14 while the corresponding socket contacts 26 are positioned in body 16. The plug socket contacts extend longitudinally within the connector bodies 14 and 16 substantially the total length of the bodies from the forward or facing ends of the bodies to the rearward or back ends of the bodies. As defined herein, the forward end of a connector element is the end facing the other connector element and the rearward or back end is the end connected to the cable.

Figure 2:
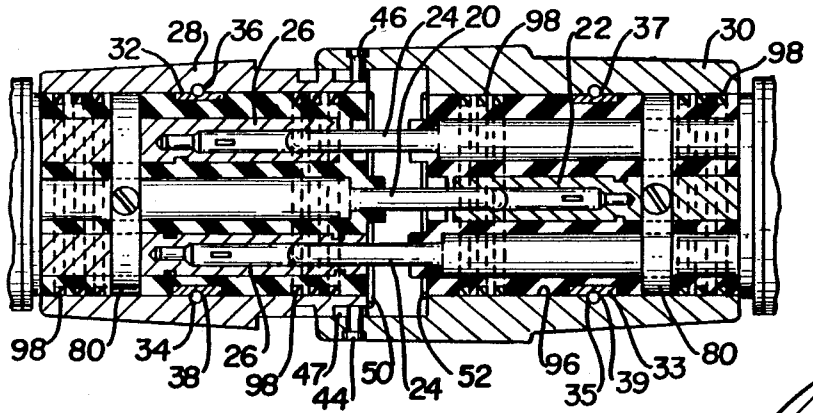
FIG. 2 is a fragmentary longitudinal sectional view with parts partially in elevational view showing the complimentary connectors in a partly coupled position taken on the plane on line 2—2 on FIG. 1.

As is customary practice in electrical connectors of this general type, the contacts of the power circuits and ground circuit are selected and positioned in such a manner as to be brought into engagement simultaneously as shown in FIG. 2. The ground plug contact 20 is usually a little longer than the power plug contacts 24 so that the ground plug socket connection is made up first and broken last when making up and breaking out the electrical connection. This insures that both sides of the electrical connection are properly connected to a grounded source before the power contacts make up a live electrical connection.

The structure for coupling the complimentary connector elements includes a pair of collars 28 and 30 associated with the respective connector elements 10 and 12. As shown in FIG. 2, the body portion 14 of connector elements 10 is provided with an annular channel in which is positioned an annular sleeve 32 having an annular groove 34 which forms a race for ball bearings 36. Collar 28 is provided with an internal annular groove 38 in which the ball bearings 36 ride, groove 38 being somewhat elongated longitudinally to provide a slight clearance for the longitudinal movement of collars 28 relative to bodies 14 for purposes hereinafter set forth. Collar 30 is mounted for rotational movement relative to body 16 in the same manner, with an annular sleeve 33 being secured in an annular channel formed in body 16. Annular sleeve 33 has a central groove 35 extending circumferentially thereof providing a race for ball bearings 37. The collar 30 is also provided with an annular internal groove 39 and, as in the case of groove 38, it extends somewhat longitudinally to thereby provide a slight clearance for movement of the collar 30 longitudinally with respect to body 16 for purposes also explained hereinafter. Although both collars 28 and 30 have been illustrated and described as being freely rotatable relative to their respective connector bodies, it should be understood that either of these bodies could be integrally secured to its respective body as long as at least one of the collars is allowed to rotate.

The manner of coupling the collars 28 and 30 together and at the same time moving the plug-socket connector elements relative to each other to complete the various circuits includes a pair of heavy threads or square-cut spiral grooves 40 and 42 each of which extends approximately 270° about the collar 28 and begins and ends at diametrically opposed points thereon (FIG. 1). A pair of diametrically opposed pins 44 and 46 are secured to and extend radially inward from collar 30 and are engagable with the respective grooves 40 and 42. Each groove 40 and 42 is provided with a longitudinally extending entrance portion 47 such that when the complimentary connector elements are moved by hand into abutting end-to-end relation, the pins 44 and 46 enter the entrance portion 47 of their respective groove. The collars are then in a position to begin coupling rotation and upon initiation of such rotating action the coupling pins enter from the longitudinal entrance portions 47 in their respective spiral groove portions 40 and 42.

The grooves 40 and 42 extend only approximately 270° around the collar 28 with the circuits being completed through the connector by merely rotating the collars through this 270° arc. As can be seen in FIG. 1, shown in solid line with respect to groove 42, the grooves terminate in a leveled off position 48 (i.e. a portion which lies at a slight angle with respect to the normal groove course and substantially perpendicular with respect to the longitudinal axis of the connector). Referring to FIG. 2, the mutually facing end portions of the bodies 14 and 16 are beaded at 50 and 52, respectively, and it is apparent that with these end portions being brought together into abutting relation upon rotation of the collars through approximately 270°, continued rotation to thus move the connector pins 44 and 46 along the leveled-off portions 47 of the grooves will maintain the facings 50 and 52 in compression to thereby completely seal, and at the same time, lock the connector elements 10 and 12 against longitudinal displacement.

In the embodiment shown in FIG. 1, wherein the connector is used to couple two conductor cables together to complete a circuit therethrough, the insulated cable is designated generally 54. Since both sides of the cable are secured to the connectors in a like manner, only one side of the connector assembly will be described. The cable 54 is shown as including a ground conductor lead 56 and a threesome of power conductor leads 58 all extending through suitable elongated grooves 60 in a barrier-like portion 62 which is integral with the back end of the body of the connector. The ground conductor lead 52 and power conductor leads 58 are secured within the connector bodies with set screws (not shown) or the like as is well known in the art and reference to U.S. Pat. No. 2,830,282 to Swan et al is made which discloses in greater detail the manner of connecting the ground and power conductor leads into the bodies 14 and 16. The ground leads 56 are connected to the ground plug and socket contacts 20 and 22 of bodies 14 and 16 and the power conductor leads 58 are connected to the power plug and socket contacts 24 and 26 of bodies 14 and 16.

To make the union between the cable and the connector element water tight, there is provided an elongated somewhat tapered sleeve or shroud 64 which encompasses a portion of the connector body at its forward end and the cable at its rearward end. Sleeve 64 is suitably formed to fit tightly over a flanged portion 66 of the connector body with an annular clamp 68 being positioned around the sleeve forward of flange 66 to thereby draw the sleeve into sealing contact with the connector body. Sleeve 64, adjacent its rearward end, is provided with an annular flanged portion 70 and immediately forward thereof a portion having a generally longitudinally flattened outer surface 72 of smaller external diameter than the portions adjacent thereto on either side. The rearward end of the sleeve is clamped to the housing of the cable 54 by means of one or more annular clamps 74 surrounding portion 72 of the sleeve. It is readily apparent therefore that with the sleeve 64 securely clamped to the connector body and to the cable housing, a water-tight fitting is effected between the cable and the connector.

Figure 4:
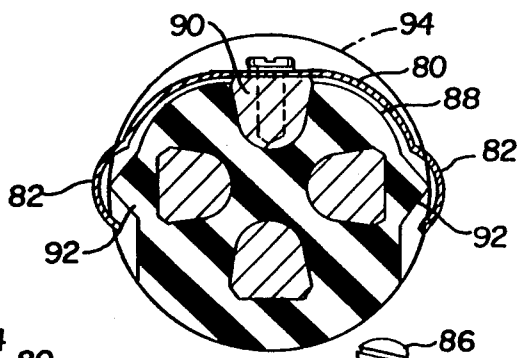
FIG. 4 is a similar view to FIG. 3 showing the body portion with the spring contact in position without the cooperating collar surrounding the body portion such that the spring contact is seen in its expanded position extending beyond the outer periphery of the body portion.
Figure 5:
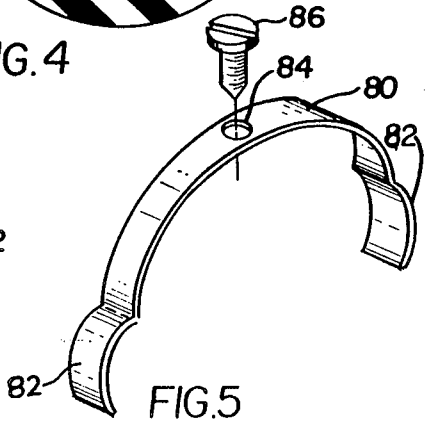
FIG. 5 is a perspective view of the spring contact and connecting screw.
Figure 3:
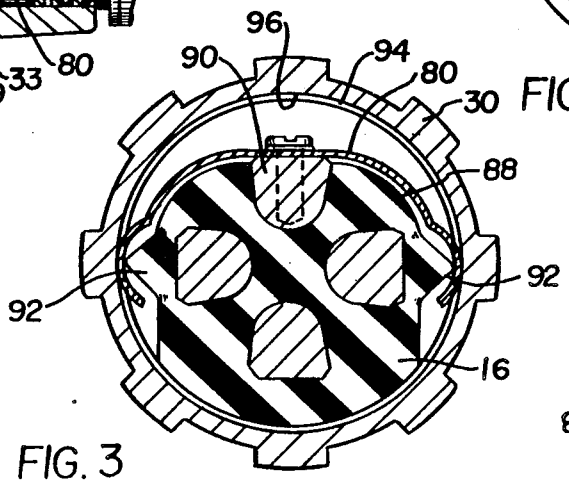
FIG. 3 is a transverse sectional view taken on the plane on line 3—3 or FIG. 1.

Referring particularly to FIGS. 3–5, the electrical connector with grounded collars is shown in greater detail. Since both collars 28 and 30 are grounded to respective bodies 14 and 16 and the ground circuit in a like manner, only one side of the connector assembly will be described. The description and reference numbers apply equally to both connector elements 10 and 12. Referring to FIG. 5, a metal spring contact 80 is shown in its pre-formed shape. The spring contact 80 is generally U-shaped with two half-moon-shaped extensions 82 on the free ends thereof. The half-moon extensions 82 face each other or open into the interior of the U-shaped spring contact. The spring contact is provided with a mounting hole 84. A screw 86 is utilized to secure the spring contact 80 to body 16. Referring to FIGS. 1 and 4, the spring contact 80 is shown in position about body 16.

In FIG. 4, the body 16 is shown in cross-section and a reduced diameter spring contact mounting area 88 is provided. The mounting area 88 is formed so as to expose a portion 90 of the ground contact and is provided with diametrically opposed triangularly-shaped (in cross section) tips 92. The tips 92 are formed of rubber or neoprene as is the rest of the body 16 and, therefore, the tips 92 are somewhat resilient. The spring contact 80 is secured directly to the ground contact portion 90 with screw 86 passing through hole 84 into the ground contact to insure that a good electrical connection is made between the ground contact and the spring contact.

As is shown in FIG. 4, the normal pre-formed shaped of the metal spring contact 80 allows a portion of the spring contact extensions 82 to radially extend outside the outer periphery 94 of body 16. Referring to FIG. 3, the body 16 is shown with its cooperating collar 30 in place about its outer periphery 94. The collar 30 has an inner peripheral surface 96 of slightly larger diameter than that of the body 16 so as to be closely received about body 16. It is necessary to radially depress the spring contact extensions 82 radially inward so that the spring contact will fit within the inner peripheral surface 96 of the collar. Since the outer extremeties of the rubber tips 92 are sized to terminate at the outer periphery of body 16, the compressed spring contact extensions 82 will also compress the resilient tips 92. Thereby, a double force is created which continually pushes the spring contact extensions into contact with the inner collar surface 96; first, the normal spring force of the metal spring contact trying to retain its preformed shape and second, the outward force of the compressed resilient tips 92 of body 16 acting on the spring contact extensions.

The inner collar surface 96 is polished to a smooth finish to insure that the spring contact 80 stays in continuous contact with the collar during rotation of the collar and while it is at rest. The connector elements 10 and 12 are also provided with a plurality of plastic seal rings 98 positioned about the bodies 14 and 16 to seal between the bodies 14 and 16 and collar 28 and 30, respectively. The seal rings 96 isolate the spring contacts 80 and copper races and ball bearings from the outside environment to protect them from external contaminants.

Each spring contact contact has two contact points between the extensions 82 and the metal collar thereby providing a double safety feature in each connector element. The spring contact is securely connected to the connector element's internal ground contact which would be connected directly to a potential ground source (not shown). When connecting the connector elements 10 and 12, the ground plug and socket contacts 20 and 22 are mated first thereby providing each metal collar 28 and 30 with a solid connection to an external ground source. If a power plug and socket contact 24 and 25 accidently energizes the metal collar, the live power surge would immediately be directed to the internal ground contact of the connector elements 10 and 12 and then to the appropriate external ground source. This occurrence would cause the circuit breaker (not shown) at the power source to break the live power circuit so quickly that no harm would come to any personnel in contact with the exposed metal collars of the connector elements 10 and 12. Likewise, it will be obvious that upon uncoupling the connector elements 10 and 12, the ground plug and socket contacts 20 and 22 will be disconnected after the power contacts to insure that both connector bodies 14 and 16 and their respective collars 28 and 30 are provided with a direct current path to the external ground source at all times when there is live electrical power connection between the connector elements 10 and 12.

From the above description of the present invention, it can be seen that the illustrated embodiment disclose a novel and improved electrical connector in which the rotating collars of the respective connector elements are provided with a direct current path to the internal ground contacts of the connector elements and, subsequently, to an external ground source. Further, the connector elements can be quickly and easily brought together with less than a complete turn of the collars to thereby complete the circuits therethrough and at the same time, seal the plug and socket contact connections from external conditions. Further, the connector elements are each provided with seal rings to protect the internal grounding mechanism and race bearings from external contaminants. It should be understood, however, that the connector unit as illustrated and described above, is by way of example only and that any changes that might occur to one skilled in the art are contemplated within the scope of the following claims.

I claim:

1. An electrical connector assembly comprising:

a cylindrical body carrying at least one power lead and a ground lead, said body having a mounting area provided on a portion of the outer periphery of said cylindrical body, the mounting area exposing a portion of the ground lead and having at least one resilient tip extending radially therefrom;

an electrically conducting spring contact connected to the exposed portion of the ground lead within the mounting area of said body, said spring contact having at least one free end adjacent the resilient body tip extending radially outside the outer periphery of said body;

a generally cylindrical collar positioned about said body and covering said spring contact having a relatively smooth cylindrical inner surface, said spring contact having its free end radially depressed to allow said collar to fit about said body, the free end of said spring contact depressing the resilient tip of said body such that the resilient tip is continually biasing the free end of said spring contact in a radially outward direction to maintain contact between the free end of said spring contact and the inner cylindrical surface of said collar; and roller bearing means positioned between said body and collar providing for relative rotational movement between said collar and body.

2. An electrical connector assembly according to claim 1, wherein the free end of said spring contact further comprises a half-moon shaped extension extending therefrom, said extension having a concave portion and a convex surface with the half-moon extension opening radially inward toward the said body, the resilient tip of said body contacting the concave portion of the extension and biasing the convex surface of the extension into contact with the inner cylindrical surface of said collar.

3. An electrical connector assembly according to claim 1, wherein said roller bearing means further comprises:

an annular sleeve positioned about the outer periphery of said body, said sleeve having an annular groove extending about said cylindrical body;

said collar having an annular internal peripheral groove formed on its inner cylindrical surface and a radial bore extending from the internal groove to the outer peripheral surface of said collar, the collar positionable about said body such that the annular collar groove is positioned radially adjacent the annular sleeve groove to form a generally cylindrical ball bearing path between said sleeve and collar; and a plurality of ball bearings inserted through the collar bore into the ball bearing path providing for relative rotational movement between said collar and said body.

4. An electrical connector assembly having at least one power lead and one ground lead connected to external electrical power and grounding sources, comprises:

an insulating cylindrical body carrying at least one socket contact and one plug contact adapted for engagement with a plug contact and socket contact, respectively, of a second body between which two bodies relative longitudinal movement may establish and interrupt a connection between said contacts, said body having a mounting area provided on a portion of the outer periphery of said body, the mounting area exposing a portion of the ground lead and having at least one resilient tip extending radially therefrom;

an electrically conducting spring contact mounted within the mounting area of said body and electrically connected to the exposed ground lead of said connector, said spring contact having at least one free end positionable radially above the resilient tip of said body, the free end of said spring contact normally extending radially outside the outer periphery of said body; and a generally cylindrical collar positionable about said body covering said spring contact and having a relatively smooth inner cylindrical surface, said collar adapted for rotational movement about said body to provide for connection between said two bodies, said spring contact having its free end radially depressed to allow said collar to fit about said body, the free end of said spring contact depressing the resilient tip of said body such that the free end is continually biased in a radially outward direction to maintain contact with the inner cylindrical surface of said collar so that an electrical circuit is maintained at all times between said collar and the ground lead within the electrical connector.

5. An electrical connector assembly according to claim 4, wherein the spring contact further comprises:

a half-moon shaped extension extending from the free end of said spring contact, said half-moon extension having an outwardly facing convex surface with said half-moon extension opening radially inward toward the resilient tip of said body and the outwardly facing convex surface of the extension normally extending radially outside the outer periphery of said body, said half-moon shaped extension of the free end of said spring contact being radially depressed into said contact with the resilient tip of said body upon insertion of said collar about said body such that the convex surface of said extension is contacting the inner cylindrical surface of said collar, said half-moon shaped extension being continually biased by said resilient tip in a radially outward direction to maintain contact with the inner cylindrical surface of said collar.

6. An improved connector assembly of the type having a cylindrical body carrying at least one power lead and a ground lead connected to external electrical power and grounding sources, a generally cylindrical collar positioned about said body having a relatively smooth inner cylindrical surface, the collar adapted for rotational movement about said body to provide for mechanical and electrical connection of the body to another body, wherein the improvement comprises:

the body having a mounting area provided on a portion of the outer periphery of said body, the mounting area exposing a portion of the ground lead and having at least one resilient tip extending radially outward therefrom;

an electrically conducting spring contact mounted within the mounting area of said body and being electrically connected to the exposed ground lead of the body, said spring contact having at least one free end positionable radially outside the resilient tip of said body, the free end of said spring contact normally extending radially outside the outer periphery of said body when the collar is not positioned about said body; and the free end of said spring contact is adapted to be radially depressed towards said body to allow the collar to fit about said body, the free end of said spring contact depressing the resilient tip of said body such that the free end is continually biased in an outwardly radial direction by the resilient tip towards the inner cylindrical surface of the collar to maintain contact between said spring contact and the collar such that an electrical grounding circuit is maintained at all times between the collar and the ground lead of the electrical connector.

* * * * *